US006457844B2

(12) United States Patent
Hess

(10) Patent No.: US 6,457,844 B2
(45) Date of Patent: Oct. 1, 2002

(54) LIGHT DISTRIBUTOR FOR A LIGHTING DEVICE AND LIGHTING DEVICE AND USE OF A LIGHTING DEVICE

(75) Inventor: Jean-Marc Hess, Münchenstein (CH)

(73) Assignee: Regent Beleuchtungskoerper AG, Basel (DE)

( * ) Notice: Subject to any disclaimer, the term of this patent is extended or adjusted under 35 U.S.C. 154(b) by 0 days.

(21) Appl. No.: 09/849,970

(22) Filed: May 8, 2001

(30) Foreign Application Priority Data

May 10, 2000 (CH) ..... 0912/00

(51) Int. Cl.[7] ..... F21V 21/29
(52) U.S. Cl. ..... 362/290; 362/354; 362/291
(58) Field of Search ..... 362/290, 291, 362/354, 223, 224, 342

(56) References Cited

U.S. PATENT DOCUMENTS

| | | | | |
|---|---|---|---|---|
| 2,996,417 A | * | 8/1961 | Wilson | 362/354 |
| 3,368,070 A | * | 2/1968 | Schwartz et al. | 362/354 |
| 4,748,547 A | | 5/1988 | Baker | |
| 4,896,656 A | * | 1/1990 | Johnson | 362/291 |
| 6,059,426 A | * | 5/2000 | Lavy | 362/223 |

FOREIGN PATENT DOCUMENTS

| | | |
|---|---|---|
| DE | 36 32912 A1 | 4/1987 |
| EP | 0 235 652 A2 | 9/1987 |
| EP | 0 870 977 A2 | 10/1998 |

* cited by examiner

*Primary Examiner*—Sandra O'Shea
*Assistant Examiner*—Bao Truong
(74) *Attorney, Agent, or Firm*—Venable; Norman N. Kunitz

(57) ABSTRACT

A lighting device has a light source and a light distributor arranged under it. Said light distributor has a distributor element which preferably consists of sheet metal and has an extensive main section with an incidence side facing the light source and a number of holes for the passage of light which widen in the direction away from the incidence side, and a collar for each of said holes. Preferably, a diffuser is arranged above the distributor element and possibly a diaphragm, preferably consisting of sheet metal, is arranged above said diffuser. The light distributor deflects and distributes light radiated downward through it, in such a way that said light makes at least a desired angle of, for example, at least 25° with a horizontal plane. The light distributor can be produced with a small height and economically and has a good antidazzle effect.

20 Claims, 5 Drawing Sheets

LIGHT DISTRIBUTOR FOR A LIGHTING DEVICE AND LIGHTING DEVICE AND USE OF A LIGHTING DEVICE

BACKGROUND OF THE INVENTION

1. Field of the invention

The invention relates to a light distributor for a lighting device and a lighting device having at least one light distributor.

The lighting device may consist, for example, of a light, such as, for example, a pendant, built-in, standard or wall light, which has, as a light source, at least one electric lamp, for example at least one tubular and/or U-shaped fluorescent lamp. The lighting device may, however, also be in the form of a luminous-band lighting device which has a rail and at least one row of lamps which follow one another along said rail and, for example, in turn consist of tubular and/or U-shaped fluorescent lamps. The lighting device is intended in particular for use in a room, for example a large office, in which at least one person works at a screen.

2. Description of the prior art

Lighting devices disclosed in EP 0 235 652 A have a light source with a fluorescent lamp and a light distributor arranged under the light source and having a distributor element which consists of a flat sheet-metal piece with a number of holes for the passage of light. In some variants, the sheet-metal piece is provided with downward-projecting collars. The holes for the passage of light are either completely or for the most part cylindrical and, in the latter case, have a section tapering downward from the upper end. The ratio of the lengths to the cross-sectional dimensions of the holes is established so that the light transmitted directly through the holes for the passage of light makes, with a horizontal plane, an angle at least equal to a predetermined stopping angle. If the bounding surfaces of the holes for the passage of light are at least to some extent light-reflecting, light generated by the light source in such a lighting device can, however, be radiated, after being reflected once or several times by the bounding surfaces of the holes for the passage of light, also in "flat", i.e. almost horizontal, directions through the holes of the distributor element into the room containing the lighting device and directly onto a screen arranged in this room. Such light can moreover be reflected by the screen into the eyes of a person working at said screen and can dazzle said person. Thus, if said bounding surfaces are to some extent light-reflecting, the known lighting devices cannot truly avoid dazzling. If, on the other hand, the bounding surfaces of the holes for the passage of light were to completely absorb the light incident on them, there would be only a low yield of the light generated by the light source.

Other known light distributors have a grid of lamellae which serve as a distributor element and have two edge strips parallel to one another or a frame having four edge strips and a number of lamellae fastened to the edge strips and/or possibly to one another. The edge strips and lamellae consist of thin, light-reflecting sheet-metal pieces. The lamellae are usually a few centimeters apart. Furthermore, the edge strips and lamellae are usually a few centimeters high. Such light distributors therefore have the disadvantage that the grids of lamellae occupy a relatively large height of, for example, at least or about 2 centimeters, which is often undesired. Furthermore, a large number of individual lamellae has to be produced and in particular individually fastened. The production and the assembly of a grid of lamellae are therefore very expensive.

SUMMARY OF THE INVENTION

It is the object of the invention to provide a light distributor which eliminates disadvantages of the known light distributors. The light distributor should in particular make it possible to suppress direct light radiation in undesired directions and nevertheless occupy only a little space, especially only a small height region. The light distributor should furthermore be economical to produce and permit a high light yield.

This object is achieved, according to the invention, by a light distributor for a lighting device, comprising an integral distributor element which has an extensive main section with an incidence side intended for turning toward a light source, a radiation side facing away from said incidence side and a number of holes for the passage of light, wherein each hole has a bounding surface and wherein the holes widen from the incidence side to the radiation side, at least for the greatest part of their bounding surface.

The invention furthermore relates to a lighting device having at least one light distributor, comprising an integral distributor element which has an extensive main section with an incidence side intended for turning toward a light source, a radiation side facing away from said incidence side and a number of holes for the passage of light, wherein each hole has a bounding surface, wherein the holes widen from the incidence side to the radiation side, at least for the greatest part of their bounding surface, and wherein said lighting device has at least one lamp holder for holding at least one electric lamp in such a way that it radiates light to the light distributor during operation.

The invention also relates to a use of the lighting device having at least one light distributor, comprising an integral distributor element which has an extensive main section with an incidence side intended for turning toward a light source, a radiation side facing away from said incidence side and a number of holes for the passage of light, wherein each hole has a bounding surface, wherein the holes widen from the incidence side to the radiation side, at least for the greatest part of their bounding surface, wherein said lighting device has at least one lamp holder for holding at least one electric lamp in such a way that it radiates light to the light distributor during operation and wherein the lighting device is arranged in such a way that all light radiated through the light distributor and out of it makes an angle with a horizontal plane.

BRIEF DESCRIPTION OF THE DRAWINGS

The subject of the invention is explained below with reference to embodiments shown in the drawing. In the drawings.

DESCRIPTION OF THE PREFERRED EMBODIMENTS

Figure 1:
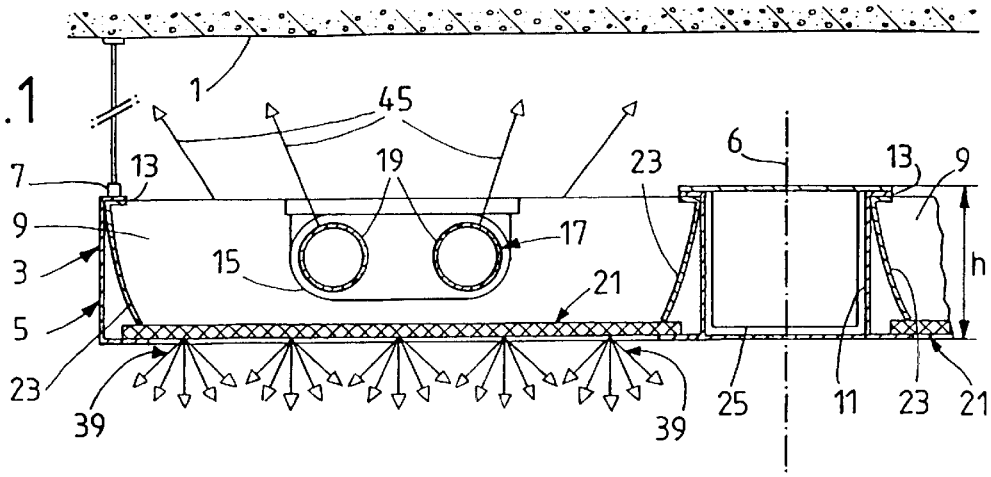
FIG. 1 shows a simplified vertical section through a lighting device suspended from a room ceiling and having a flat light distributor.

FIG. 1 shows a ceiling 1 of a room of a building, for example of a large office, and a lighting device 3. The latter is in the form of a pendant light and has a housing 5 consisting substantially of sheet metal. The housing 5 shown only in part is substantially symmetrical with respect to a vertical central plane 6. The housing is held, namely movably suspended, from the room ceiling 1 by retaining means 7 and separated from the room ceiling by a free intermediate space. The housing 5 bounds two light source chambers 9 arranged on different sides of the vertical central plane 6 and a device chamber 11 arranged at the same height between said light source chambers. Each light source chamber 9 can be at least substantially open at the top and have at least one orifice 13.

The light source chamber 9 contains at least one lamp holder 15, namely, for example, two lamp holders 15 opposite one another and a distance apart. The light source chamber furthermore contains an artificial light source 17 having at least one electric lamp 19, namely, for example, two tubular, straight fluorescent lamps, which are held by the lamp holders parallel to one another and a small distance apart. In each light source chamber, a light distributor 21 is fastened under the lamps 19, in the vicinity of the lower edges of the light source chamber 9, to the housing 5. The light distributor 21 has in general the form of a flat, horizontal, quadrilateral, namely rectangular plate, the two longer edges of the light distributor being parallel to the tubular fluorescent lamp. The light distributor closes the light source chamber at least for the most part at the bottom. The housing 5 contains two side reflectors 23 which are fastened to it, run along the tubular fluorescent lamps 19 and are arranged on those sides of said lamps which face away from one another. The reflectors 23 are arranged in the vicinity of the lateral boundaries of the light source chamber and/or form these boundaries at least in part. The side reflectors 23 extend from the upper edges of the housing downward at least almost to the light distributor 21, so that the lower edges of the reflectors are present, for example, in the vicinity of the longer lateral edges of the light distributor, on the upper side thereof. The side reflectors are, for example, inclined downward toward one another. Those faces of the reflectors 23 belonging to the same light source which face one another are light-reflecting and, for example, concave in vertical section. Furthermore, the inner surfaces of the two end walls of the housing which bound the light source chambers 9 at their ends are also preferably light-reflecting. The device chamber 11 contains at least one ballast 25 and, for example, an electronic ballast for each lamp.

Figure 2:
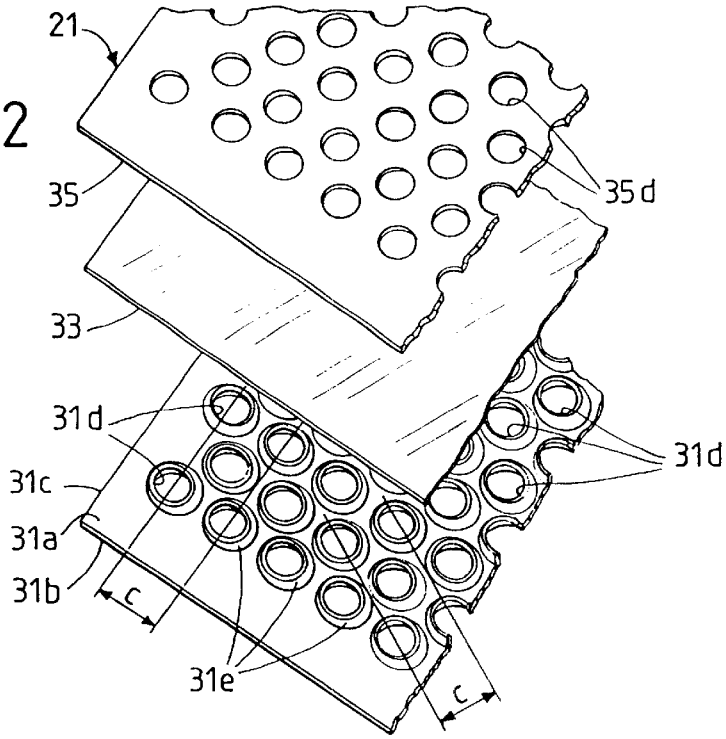
FIG. 2 shows an exploded view of the light distributor.
Figure 3:
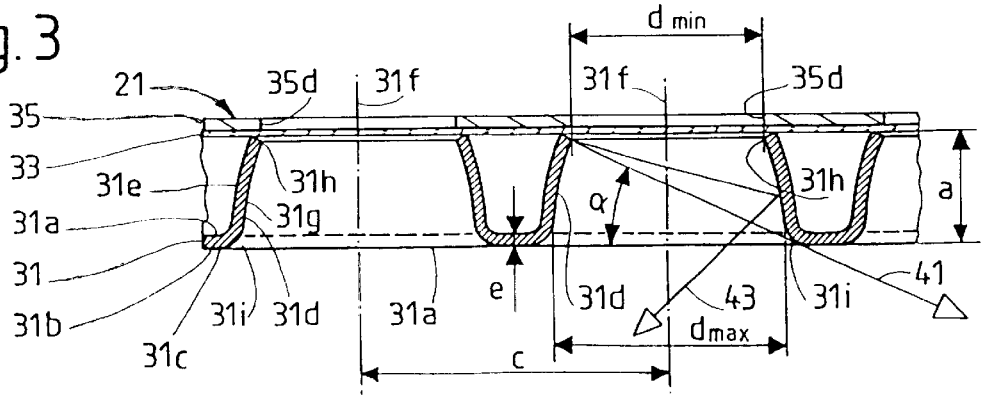
FIG. 3 shows a vertical section through a section of the light distributor on a larger scale than FIG. 1.
Figure 4:
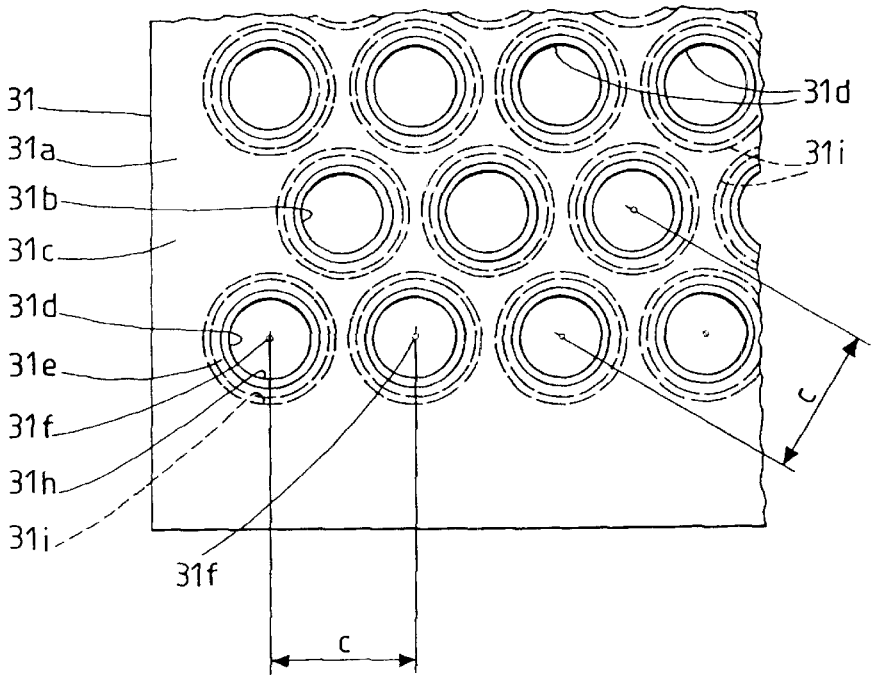
FIG. 4 shows a plan view of a section of the distributor element of the light distributor.

One of the light distributors 21 is shown separately in FIGS. 2 and 3 and has three originally separate parts rigidly connected to one another, each of which is integral, namely, from bottom to top, a distributor element 31, a diffuser 33 and a diaphragm 35. The distributor element 31 also shown separately in FIG. 4 and at least substantially plate-like has an upper side or surface which faces the light source 17 and is referred to below as the incidence side 31*a* and/or incidence surface 31*a*. That lower side or surface of the distributor element 31 which faces away from the light source 17 is referred to as the radiation side 31*b* and/or radiation surface 31*b*. The distributor element 31 has an extensive, i.e. substantially two-dimensional, and substantially flat main section 31*c* and a number of identically formed and identically dimensioned, uniformly distributed, light-permeable holes 31*d* for the passage of light. The distributor element 31 is provided with a collar 31*e* at each hole 31*d* for the passage of light. On the incidence side or surface 31*a*, said collar projects upward away from the extensive, flat main section 31*c* of the distributor element 31. Each hole 31*d* for the passage of light, together with the collar 31*e* coordinated with it, defines a straight hole axis 31*f*. The hole axes 31*f* of all holes 31*d* are parallel to one another, at right angles to the plane defined by the main section 31*a* and its radiation side 31*b* and, if the lighting device is mounted on the room ceiling 1, approximately vertical. Each hole 31*d* for the passage of light is bounded by a hole bounding surface 31*g* surrounding its hole axis 31*f* and has a first, upper hole end 31*h* present on the incidence side 31*a* of the distributor element 31 and a second, lower hole end 31*i* present on the radiation side of the element 31. Each hole 31*d* has a circular contour in a plan view of the distributor element 31 and extends from the first, upper hole end 31*h* to the second, lower hole end 31*i*. The hole bounding surface 31*g* of each hole 31*d* for the passage of light is smooth and continuously curved in all axial sections passing through its hole axis 31*f*, at least for the greatest part of its axial dimension and in fact preferably everywhere and is directed outward from the first hole end to the second hole end, away from the hole axis. Each hole bounding surface is furthermore at least for the most part slightly concave at all circumferential points, at least for the greatest part of the axial hole dimension, namely from the upper, first hole end into the lower part of the hole, in all axial sections. However, each hole bounding surface 31*g* has, at the second, lower hole end 31*i*, preferably a short transition section which is convex in axial section and connects the remaining, concave part of the hole bounding surface 31*g* smoothly and continuously to that flat part of the radiation surface 31*d* formed by the main section 31*c*. The curvature of the hole bounding surfaces is moreover preferably established in such a way that each hole bounding surface is inclined, at least approximately over its total height, downward away from the hole axis of the relevant hole.

Each hole 31*d* for the passage of light has dimensions shown in FIG. 3, namely an axial dimension or height a measured parallel to its hole axis, a minimum diameter $d_{min}$ at the first, upper end and a maximum diameter $d_{max}$ at the second, lower end. The diameter $d_{min}$ is of course equal to the internal diameter of the hole. The hole axes 31*f* of the holes 31*d* closest to one another have an interaxial spacing c. The thickness or—more precisely—material thickness of the distributor element, measured at the flat main section 31*c*, is denoted in FIG. 3 by e.

The axial dimension or height a of the holes 31*d* for the passage of light is preferably at least 30%, preferably at most 100% and, for example, about 40% to 80% of the clear width, i.e. of the internal diameter or of the minimum diameter $d_{min}$. The internal diameter $d_{min}$ is preferably at least 2 mm, expediently at most 15 mm, preferably at most 10 mm and, for example, about 3 mm to 8 mm. The maximum diameter $d_{max}$ of the holes 31*d* is preferably at least 10% and more preferably at least 20% to, for example, about 80% greater than the minimum diameter $d_{min}$. The axial dimension a of the holes 31*d* is preferably at least 1.5 mm, expediently at most 15 mm, preferably at most 10 mm and, for example, 2 mm to 5 mm. The material thickness e is preferably at most 1 mm, more preferably at most 0.7 mm and, for example, about 0.5 mm. The axial dimension a of the holes 31*d* is thus substantially greater than the material thickness e and is preferably at least 2 times, more preferably at least 3 times and, for example, about 5 times to 10 times said material thickness. Each hole bounding surface 31*g* is accordingly at least for the greatest part formed by the inner surface of the collar 31*e* present at the relevant hole.

The holes 31*d* which are closest together can form, for example, straight rows of holes parallel to the shorter edges of the distributor element. The hole axes of the rows of holes closest together are shifted half an interaxial spacing c relative to one another in the longitudinal directions of the rows of holes. The rows of holes are furthermore a distance apart so that the axes of those holes of two adjacent rows of holes which are closest together have the same interaxial spacing c as the holes belonging to the same row of holes. The holes are thus distributed in the manner of a closest packing over the surface of the distributor element. However, said packing has narrow hole-free edge strips at the edges. The interaxial spacing c is preferably at most 50% and, for example, only about 20% to 40% greater than the maximum diameter $d_{max}$ of the holes 31*d*. The main section 31*c* of the distributor element 31 accordingly has only relatively narrow webs between the holes closest together. Furthermore, in the ground plan, the holes 31*d* for the passage of light occupy a relatively large part of the surface of the distributor element, so that the latter permits high light transmission.

The distributor element 31 of each light distributor consists of a material which is opaque to light, namely of sheet metal, for example of aluminum or of an aluminum alloy. At least the hole bounding surfaces 31*g* and that radiation surface 31*b* of the distributor element 31 which is associated with said bounding surfaces and/or forms said bounding surfaces should have good light-reflecting properties and be mirror-like. "Mirror-like" means that the reflecting surfaces are at least almost completely smooth and reflect the light according to the laws of reflection, so that an incident light beam and a reflected light beam make equal angles with a perpendicular to the reflecting surface. The distributor element is provided, preferably in the case of the radiation surface and the hole bounding surfaces, with a reflection layer which is formed by anodizing and is, for example, also coated with a very thin protective layer which is very transparent to light. The reflection layer and any protective layer can be produced in manners known for the production of reflectors for lights. The incidence surface 31*a* and those outer surfaces of the collars 31*e* which are associated with said incidence surface and/or formed by said incidence surface can, for example, likewise have good light-reflecting properties and be mirror-like and have a reflection layer formed by anodizing. However, the incidence surface and the outer surfaces of the collars can instead likewise have good light-reflecting properties but need not be mirror-like but divergently and/or diffusely light-reflecting and can cause an incident light beam to diffuse on reflection to give a bundle of rays and/or radiate said light beam more or less according to Lambert's law. Both in the case of mirror-like reflection and in the case of diffuse reflection, the reflected stream of light can amount to at least 80% and, for example, at least 90% of the stream of light radiated onto the reflecting surface. If a diaphragm 35 is also present, the incidence surfaces 31*a* and the outer surfaces of the collars 31*e* need not necessarily however have a high reflecting coefficient.

The diffuser 33 of each light distributor consists of a completely flat film of a material which is transparent to light but matt on one or each of the two film surfaces and, for example, clear in the interior, for example a plastic, such as polyester or polycarbonate or polymethacrylate. However, instead of having a matt surface, the film could be opaque in the interior or both matt and opaque. The diffuser is present on the incidence side 31*a* of the distributor element 31 and rests on the upper edges of the collars 31*e*. The diffuser 33 is completely flat and is hole-free at least in the region of those holes 31*d* of the distributor element 31 which are intended for the passage of light, and, for example, completely hole-free and compact. The diffuser therefore completely covers the holes 31*d* for the passage of light. The thickness of the diffuser is preferably at most 0.5 mm, more preferably at most 0.3 mm and, for example, about 0.1 mm. The diffuser is thus substantially thinner than the distributor element. The diaphragm 35 of each light distributor is present between the light source 17 and the diffuser 33 and rests on the latter. The diaphragm 35 consists at least substantially of a completely flat plate and has, for each hole 31*d* of the distributor element 31 which is intended for the passage of light, a circular hole 35*d* for the passage of light, which is coaxial with said hole 31*d*. The diameter of the holes 35*d* of the diaphragm 35 which are intended for the passage of light is, for example, approximately equal to the diameter $d_{min}$ of the holes 31*d* of the distributor element 31 which are intended for the passage of light. The holes 33*d* thus approximately coincide with those first hole ends 31*h* of the holes 31*d* which face them. The diaphragm 35 consists of a material opaque to light, namely, as in the case of the distributor element 31, of a sheet comprising aluminum or an aluminum alloy. At least that upper surface of the diaphragm which faces the light source 17 and faces away from the distributor element 31 should have good light-reflecting properties and is provided, for example, with a reflection layer formed by anodizing. The diaphragm 35 has, for example, approximately the same thickness as the flat main section of the distributor element 31.

The distributor element 31, the diaphragm 35 and that diffuser 33 of each light distributor 21 which is arranged between them are firmly and rigidly connected to one another at their edges by connecting and/or fastening means, so that they together form a plate-like unit. The connecting and/or fastening means may have, for example, hook-like and/or approximately L-shaped clamping sections which are arranged on at least two edges facing away from one another or on all four edges of the light distributor 31 or of the diaphragm 35, not shown, associated with the remaining part of the distributor element or of the diaphragm, overlapping the edges of the other parts of the light distributor and clamping together and holding together these parts. Moreover, the three parts 31, 33, 35 may also be provided, at their edges, with fastening holes or other fastening means which are not shown, in order to fasten to the housing 5 the light distributor 21 formed at least for the most part or exclusively by them.

The total height of the light distributor 21 is substantially—i.e. apart from, for example, the abovementioned connecting and/or fastening means present—equal to the sum of the axial dimension a of the holes 31*d* of the distributor element 31 which are intended for the passage of light and of the thickness of the diffuser 33 and of the diaphragm 35. The height of the light distributor 31 is thus only slightly greater than the axial dimension a of the holes 31*d* and, like these, can expediently be at most 15 mm, preferably at most 10 mm or even only at most 5 mm. The small height of the light distributor 21 permits the entire housing 5 of the light also to be made relatively low. The height of the housing 5 of the pendant light which is denoted by h in FIG. 1 is preferably at most 50 mm, for example only at most about 40 mm and possibly only about 30 mm.

For the production of light distributors 21, sheet metal pieces having the contours and dimensions desired for the formation of distributor elements 31 and diaphragms 35 are cut from flat sheet-metal panels which already have at least one reflection layer formed by anodizing. A flat sheet-metal piece serving for the formation of a distributor element is then provided with the holes 31*d* for the passage of light by punching and with the collars 31*e* by forming or plastic deformation, namely deep-drawing. A plurality of holes 31*d*, for example at least one row of holes, or possibly even all holes 31*d* of the distributor element 31 can be punched simultaneously from the originally hole-free sheet-metal piece. Similarly, a plurality of collars 31*e* or even all collars 31*e* can be formed simultaneously by deep-drawing. Moreover, for example, the holes 31*d* can first be punched out using a punching tool and the collars 31*e* can then be formed using a forming tool. However, it is also possible to punch holes and to form collars simultaneously, i.e. with one and the same tool movement, using a combined punching and forming tool. During forming of the collars, the sheet-metal piece is arranged in such a way that at least that originally flat surface of the sheet-metal piece which forms both the flat part of the radiation surface 31*g* and the hole bounding surfaces 31*g* subsequently in the finished distributor element is anodized and light-reflecting. The punching of the holes 31*d* and forming of the collars can be effected in such a way that the optical reflection properties of the distributor element are retained and that no aftertreatment thereof is necessary. The holes 35*d* of the diaphragm 35 can also be formed, for example, by punching, the diaphragm likewise retaining its optical reflection properties without aftertreatment.

When the lighting device 3 is used, the light generated by the lamps 19 in each light source chamber 9 can be radiated directly and possibly—depending on the formation of the housing and of the reflectors 23 and any other reflectors—after at least one prior reflection by reflecting walls of the housing and/or reflectors downward to the light distributor 21 of the relevant light source chamber. A part of this light can be radiated through holes 35*d* of the diaphragm 35 which are intended for the passage of light, through the diffuser 33 and through the holes 31*d* of the distributor element 31 which are intended for the passage of light, into the space present under the light distributor. The light distributor 21 deflects and distributes this light. The diffuser 33 scatters the light reaching it and passing through it, so that a bundle of light rays having different directions is radiated at the lower hole end 31*i* of each hole 31*d* for the passage of light and belonging to the distributor element 31. Some of such bundles of light rays are indicated in FIG. 1 and denoted by 39.

When light passes through the light distributor, light incident vertically and/or at least at a more or less steep angle downward on the incidence side or surface 31*a* of the distributor element 31 can pass without reflection by the hole bounding surfaces 31*g* through the holes 31*d* and can be emitted from the distributor element on the radiation side and/or surface 31*b* of said element. The light radiated through the holes 31*d* directly and without reflection by the hole bounding surfaces 31*g* can make, with an approximately horizontal plane at right angles to the hole axes 31*f*, an angle which is at least equal to a minimum angle denoted by Δ in FIG. 3 for a light beam 41. This minimum angle Δ is determined by those edge points of the edges of the two hole ends 31*h* and 31*i* which are furthest away from one another and thus by the diameter of these hole ends and the axial dimension a of the holes 31*d*.

Light arriving from the light source 17 can also be radiated from above into one of the holes 31*d* in such a way that this light—such as, for example, the light beam 43 in FIG. 3—strikes the hole bounding surface 31*g* of the hole and, after single or multiple reflections by this hole bounding surface, is radiated out of the bottom of the relevant hole. The holes 31*d* widening continuously in a downward direction and their bounding surfaces 31*g* are formed in such a way that such light makes with a horizontal plane an angle which is at least equal to the minimum angle α.

The minimum angle made with the horizontal plane by the light radiated through the entire light distributor can—depending on the dimension of the diameter of the holes 35*d* of the diaphragm 35 which are intended for the passage of light—also be influenced by these holes 35*d* and may be somewhat larger than the angle α. The holes 31*d* and the holes of the diaphragm 35 can be formed and dimensioned in such a way that the minimum angle α and/or the minimum angle determined by the entire light distributor and made by the light radiated from the bottom of the light distributor with a horizontal plane is preferably at least about 25° or slightly more, for example about 30°.

The light radiated in one of the light source chambers by the light source 17 toward the diaphragm 35 and striking the upper surface of the diaphragm next to the holes 35*d* thereof which are intended for the passage of light is reflected upward again by the diaphragm. This light, together with light arriving directly from one of the lamps, can be radiated to that upper side of the housing 5 which faces away from the light distributor 21, to a large extent through the orifice 13, out of the relevant light source chamber, upward toward the room ceiling 1, and can then be thrown back by said ceiling more or less diffusely downward into a free region of the room. Furthermore, light can be reflected by the reflectors 23 or by the preferably likewise light-reflecting inner surfaces of the end walls of the housing and radiated upward out of the housing, through one of the orifices 13. The light radiated upward out of the housing 5 is indicated in FIG. 1 by a few light beams 45. The lighting device thus illuminates that region of the room which is present underneath it, both directly by means of the light distributor 21 and indirectly with light initially radiated upward toward the room ceiling 1. The diffusers 33 of the two light distributors 21 produce beam divergence and distribution of the light passing through them and prevent a person standing more or less perpendicularly under the lighting device 3 and looking at it from clearly detecting the lamps.

The formation of the housing 5 and of the reflectors 23 ensure that all the light which is radiated directly downward from the lighting device 3 passes through one of the light distributors 21 and accordingly makes with a horizontal plane an angle which is at least equal to the minimum angle $\alpha$. The light beams emerging from the bottom of the lighting device are therefore approximately vertical and/or inclined and make at most an angle complementary to the angle a with a vertical and hence an angle between 0° and $(90°-\alpha)$. The lighting device thus produces a so-called all-round antidazzle effect for light radiated directly downward. The room illuminated with the aid of the lighting device and other identical lighting devices contains at least one screen and, for example, a plurality of screens. Screens of computers and the like are usually steeply inclined and/or more or less vertical. The design of the lighting device therefore prevents light from being radiated directly from the lighting device 3 in such a "shallow" direction toward a screen that light reflected from the screen dazzles a person working at said screen. The design of the lighting device 3 and that of the light distributor 21 permit a high light yield. Furthermore, the light distributor can be produced and assembled economically. In addition, the low heights of the light distributors 21 and of the housing 5 and hence—apart from the retaining means 7—of the entire lighting device 3 give rise to many possibilities for the design of the lighting device. Those light-reflecting surfaces of the metallic, plate-like parts 31, 35 which are provided with reflection layers by anodizing result in very good light reflection and retain their reflection properties over a long time. Furthermore, at least the metallic parts 31, 35 forming the major part of the light distributors are nonflammable.

The diaphragm 35 of each of the light distributors 21 may also be omitted. If this is the case, the incidence surface 31*a* and those outer surfaces of the collars 31*e* of the distributor element 31 which are associated with said incidence surface should also have good light-reflecting properties. Particularly if no diaphragms 35 are present, each light source 17 also radiates light onto the outer surfaces of the collars 31*e* and the flat sections of the incidence surface 31*a* of one of the distributor elements 31. This light is then radiated, at least to a large extent, after single or multiple reflection, back upward and at least partly through the diffuser 33 and the orifice 13 out of the top of the housing 5. Owing to the reflection by the outer surfaces of the collars 31*e* and owing to the distribution taking place in the diffuser, a major part of this upward-reflected light then also makes a fairly large angle with a vertical.

Particularly if the light distributors 21 have no diaphragms 35, light can also be radiated into the sections of a diffuser 33 which are present next to the holes for the passage of light. The diffuser may then act more or less as an optical waveguide for a part of this light and, for example, radiate a part of such light, in the region of one of the holes 35*d* for the passage of light, downward into said region so that the diffuser can slightly increase the proportion of the light radiated through the holes for the passage of light and downward out of the housing.

Figure 5:
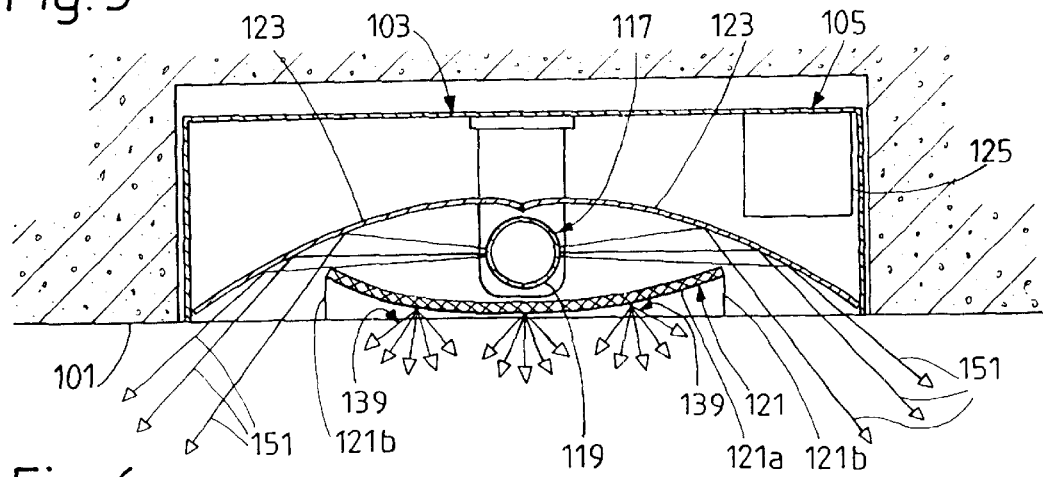
FIG. 5 shows a schematic vertical section through another lighting device having a curved light distributor.

FIG. 5 shows a room ceiling 101 and a lighting device 103 illustrated in simplified form and having a housing 105. The latter is, for example in the form of a built-in light and is sunk for the most part in a recess in the room ceiling 101. The housing bounds a light source chamber which contains an artificial, electric light source 117 having a straight, tubular fluorescent lamp 119. A light distributor 121 having a plate-like main section 121*a* is arranged under said fluorescent lamp. Said main section is straight and approximately horizontal in a direction parallel to the tubular fluorescent lamp, but is curved in a vertical section at right angles to this direction so that the upper, lamp-facing surface of the light distributor is concave. The light distributor 121 has, at the two straight longitudinal edges of the main section 121*a* which are parallel to one another and to the fluorescent lamp 119, shields 121*b* projecting downward and away from said main section. Said shields are, for example, approximately vertical or inclined downward and outward slightly away from one another and are light-reflecting at least in the case of their inner surfaces located more or less opposite one another and, for example, also in the case of their outer surfaces. The housing 105 contains two reflectors 123 whose edge sections present closest together are arranged above the lamp 119. The lower, reflecting surfaces of the reflector are concave. The reflectors project past and close to the longitudinal edges of the main section 121*a* of the light distributor 121 in a downward direction approximately up to the lower edges of the housing 105. Free spaces are present between the shields 121*b* of the light distributor 121 and the reflectors 123. The housing 103 contains a ballast 125 which is arranged, for example, above one of the reflectors 123, between this and the walls of the housing, but instead could be present, analogously to FIG. 1, in a separate chamber next to the chamber containing the light source.

Figure 6:
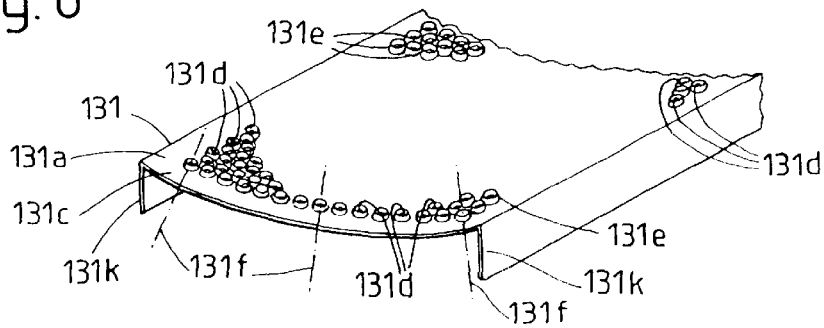
FIG. 6 shows an oblique view of the distributor element of the curved light distributor shown in FIG. 5.
Figure 7:
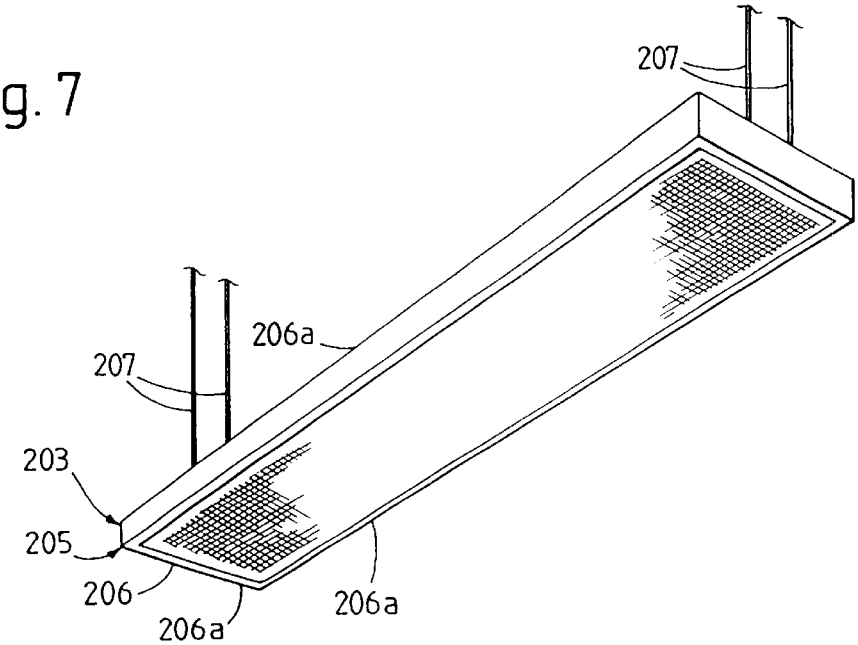
FIG. 7 shows a perspective oblique view of another suspended lighting device.
Figure 8:
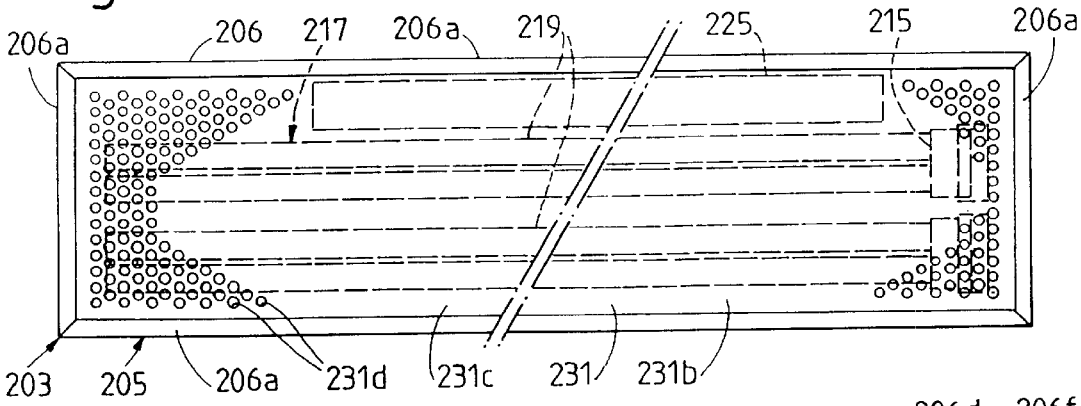
FIG. 8 shows a view from below of the lighting device shown in FIG. 7.
Figure 9:
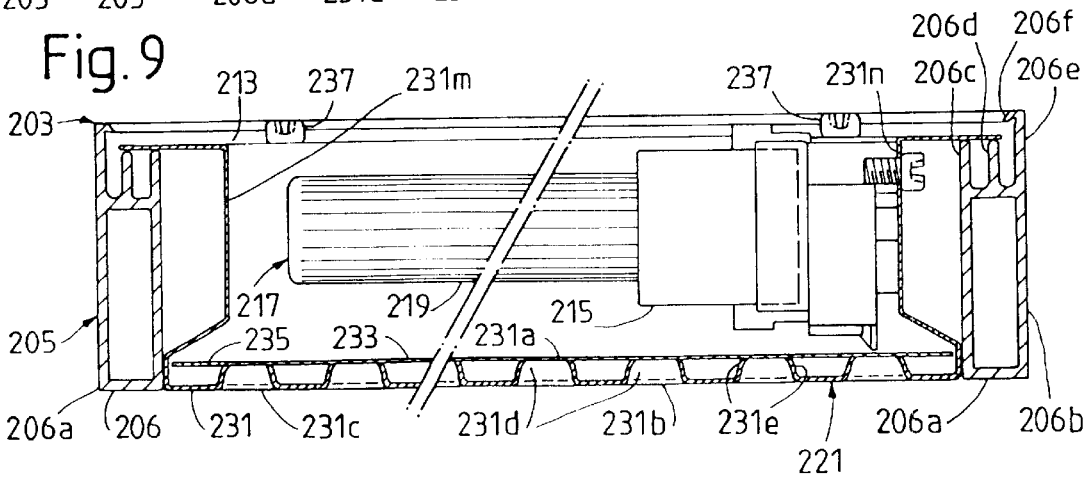
FIG. 9 shows a somewhat simplified, vertical longitudinal section through the lighting device according to FIGS. 7 and 8, on a larger scale than FIG. 8.
Figure 10:
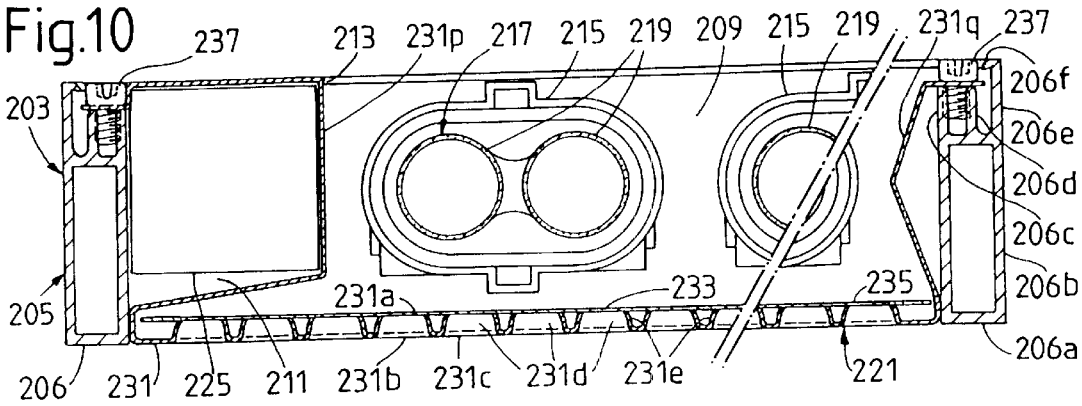
FIG. 10 shows a cross-section through the lighting device according FIGS. 7 to 10.

The light distributor 121 has a distributor element 131 shown in FIG. 6, a diffuser which is not shown and a diaphragm which is likewise not shown. The distributor element 131 has an extensive main section 131*c*. This is continuously curved analogously to the entire light distributor so that its incidence side and/or surface 131*a* is concave in a vertical section at right angles to the tubular fluorescent lamp. The main section 131*c* of the distributor element 131 has, like that of the entire light distributor 121, two longitudinal edges parallel to the tubular fluorescent lamp and two shorter, curved edges. The curved main section 131*c* of the distributor element 131 has a multiplicity of holes 131*d* for the passage of light and, at each of these, a collar 131*e* arranged on the incidence side. Each hole 131*d* defines a hole axis 131*f*. The hole axes are perpendicular to the curved main section 131*c* and to tangential planes to the curved surface defined by the main section, at the hole axes. The hole axes 131*f* are therefore not all parallel to one another but for the most part are inclined upward toward a vertical longitudinal central plane of the distributor element. The holes 131*d* for the passage of light may all be identical or possibly slightly different from one another. The distributor element 131 has, at the two straight longitudinal edges of the main section 131*c*, strip-like sections which project downward away from said main section and are designated below as shields 131*k*. The diffuser which is not shown is curved analogously to the extensive main section 131*c* of the distributor element 131. The diaphragm which is not shown has an extensive main section which is curved analogously to that of the distributor element 131 and has holes for the passage of light. The diaphragm can moreover have downward-projecting strip-like sections or shields corresponding to the shields 131*k* of the distributor element 131. Said sections or shields may be connected, at their lower edges, for example by flanges, to the shields 131*k* of the distributor element 131 and, together with these shields 131*k*, form the shields 121*b* of the entire light distributor 121 which is shown in FIG. 5. Each shield 121*b* thus has two layers and is formed from a strip-like section of the distributor element 131 and a strip-like section of the diaphragm. These strip-like sections or shields simultaneously serve as connecting means which connect the various parts of the light distributor 121 firmly to one another. However, it would also be possible to provide only the distributor element 131 or only the diaphragm with shields or to form the shields from separate parts.

During use, the lighting device 103 can radiate light beams downward through the light distributor 121 so that a bundle of light rays which contains light rays with different directions is radiated downward at each hole 131*d* for the passage of light in the distributor element 131. Some such bundles of light rays are indicated in FIG. 5 and denoted by 139. The shields 121*b* ensure that, in spite of the inclination of most hole axes, only light which makes a certain minimum angle of, for example, at least 25° with a horizontal plane is radiated downward through the holes for the passage of light. The lighting device 103 can moreover radiate light beams 151 reflected by the reflectors 123 downward on both longitudinal sides of the light distributor 121, past the latter and adjacent to it. The light distributor 121 and the reflectors 123 are formed and arranged in such a way that all light beams radiated downward past the light distributor 121 and adjacent to it make with a horizontal plane an angle which is at least equal to the desired minimum angle.

Depending on the design of the reflectors 123 and the arrangement of the ballast 125, the height of the housing 105 of the built-in light may be slightly larger than in the case of the pendant light but can still be at most 50 mm and, for example, at most or about 40 mm.

Unless stated otherwise above, the lighting device 103 may be formed similarly to the lighting device 3, have similar properties to the latter and have the advantages of the latter.

The lighting device 203 shown in FIGS. 7 to 10 is once again in the form of a pendant light and has a housing 205 with a quadrilateral, namely rectangular, frame 206. This has four frame limbs 206*a* each of which, for example, consists of a profile rod of light metal and has a hollow section 206*b* of rectangular cross-section and three ribs 206*c*, 206*d*, 206*e* projecting upward from the upper, narrower side of the rectangle. The inner rib 206*c* and the middle rib 206*d* project to the same height. The outer rib 206*e* is slightly higher and is provided on its upper, free end with an inward-projecting lug 206*f* forming a barb. The housing 205 is held on, namely movably suspended from, a room ceiling, a distance away from the latter, by retaining means 207 fastened to the longer frame limbs 206*a*.

The light distributor 221 has a distributor element 231 which has a quadrilateral, namely rectangular, extensive, generally flat main section 231*c* arranged at the lower edge of the frame 206 and possessing holes 231*d* for the passage of light. The distributor element 231 in turn has collars 231*e* projecting upward away from the extensive main section 231*c* and bounding the holes 231*d* for the most part. The upper and lower sides of the main section 231*c* form the incidence side and/or incidence surface 231*a* and the radiation side and/or radiation surface 231*b*, respectively, of the main section and of the entire distributor element 231. The main section 231*c* of the distributor element 231 is approximately flush with the lower frame surface and is associated at each of its four edges with a wall which is angled and/or bent upward away from it and also serves as a reflector and, together with these walls and/or reflectors, consists of an integral metal sheet. The end walls and/or end reflectors arranged at the two shorter edges of the main section 231*c* which are opposite one another are denoted by 231*m* and 231*n*. The side walls and/or side reflectors arranged at the two longer edges of the main section 231*c* which are opposite one another are denoted by 231*p* and 231*q*. The walls and/or reflectors 231*m*, 231*n*, 231*p*, 231*q* are located in the interior of the frame 206, almost rest against these inner surfaces at points and have, at their upper ends, approximately horizontal edge strips angled and/or bent outward. These rest, at the frame limbs 206*a*, on the edges of the inner and middle ribs 206*c*, 206*d* and are detachably fastened to the frame, for example at least at the longer frame limbs, by screws 237 screwed into said limbs from above.

The main section 231*c* and the walls and/or reflectors 231*m*, 231*n*, 231*p*, 231*q* of the distributor element 231 which are associated with said main section can in this variant also be regarded as components of the housing 205 and, together with the frame 206, bound a light source chamber 209 which has an orifice 213 at the top and is thus substantially open at the top. The end wall 231*n* is provided with at least one lamp holder 215 and namely with two lamp holders 215 arranged side by side. The light source 217 has two lamps 219 which are arranged side by side in the light source chamber 209 and in this variant consist, for example, of U-shaped fluorescent lamps, so-called PLL lamps, held at one end in one of the lamp holders. The side wall 231*p* is angled in such a way that, together with the frame limb present next to it, it bounds a device chamber 211 in which at least one ballast 225 is arranged and fixed. The other side wall 231*q* is, for example, angled in a slightly wedge-shaped manner according to FIG. 10 so that it has an apex projecting toward the light source.

The light distributor 221 has, in addition to the distributor element 231, a flat diffuser 233, which in turn consists of a plastics film transparent to light. On the incidence side 231*a* of the main section 231*c*, the diffuser 233 rests on the upper edges of the collars 231*e* and is held with little play by the walls or reflectors 231*m*, 231*n*, 231*p*, 231*q* and secured to prevent slipping. The light distributor 221 has no diaphragm corresponding to the diaphragm 35 but could possibly also have such a diaphragm.

Unless stated otherwise above, the distributor element 231 is formed similarly to the distributor element 31. If the light distributor 221 has no diaphragm corresponding to the diaphragm 35, both the incidence side or surface and the radiation side or surface should however always have good light-reflecting properties. The holes 231*d* for the passage of light and collars 231*e* of the distributor element 231 can be produced analogously to the method described for the distributor element 31. The fact that the end walls and/or end reflectors 231*m*, 231*n* and side walls and/or side reflectors 231*p*, 231*q*, together with the main section of the distributor element, are formed from an integral metal sheet helps to achieve economical production of the lighting device.

When the lighting device 203 is used, light is radiated downward through the distributor element 231 and light is radiated upward through the orifice 213 out of the housing, analogously to the use of the lighting device 3. All light radiated downward out of the housing must pass through holes 231*d* of the distributor element 231, so that, analogously to the lighting device 31, an all-round antidazzle effect is achieved. The light radiated upward out of the housing is, for example, radiated back more or less diffusely into the room by the room ceiling.

If a lamp is defective, it can be replaced through the orifice 213 without any housing parts having to be removed. If replacement of the ballast 225 is necessary, the screws 237 can be undone, the light distributor 221 together with the lamps and the ballast lifted out of the frame 206 from above and the ballast then pushed out of the device chamber 211 and replaced. The lighting device 203—as in particular the lighting device—thus permits very easy replacement of a lamp and also fairly easy replacement of the ballast.

Figure 11:
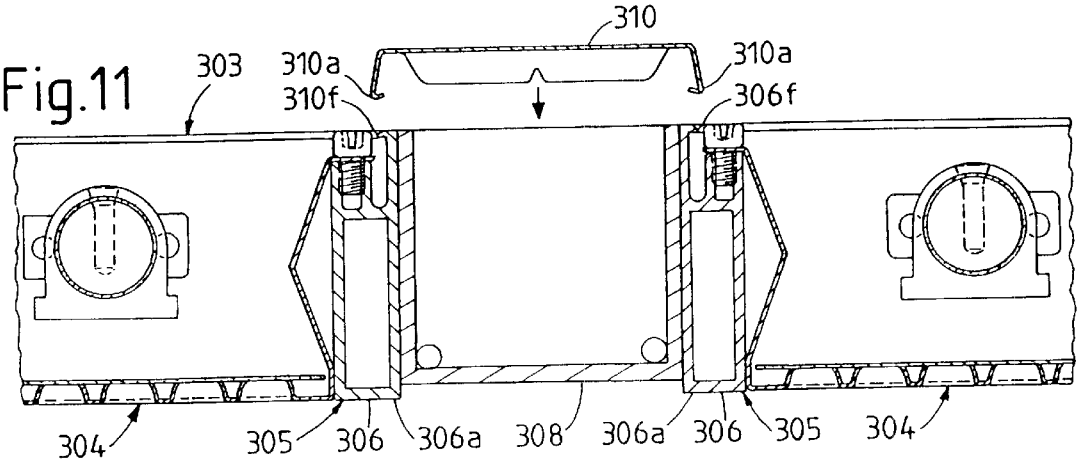
FIG. 11 shows a lighting device having two lighting units arranged side by side and connected to one another.

The lighting device 303 shown in part in FIG. 11 has two lighting units 304. Each of these is formed, for example, substantially identically or similarly to the lighting device 203 shown in FIGS. 7 to 10 and, like this, has a housing 305 with a frame 306. The two frames 306 are arranged in such a way that two of their longer frame limbs 306*a* are parallel to one another and a distance apart. Arranged between these adjacent frame limbs is a spacer 308 which has, for example, a U-shaped profile rod open at the top and/or a right parallelepiped box open at the top and extends over at least a part of the length of the adjacent frame limbs of the two lighting units. The two lighting units 304 are rigidly and detachably connected to one another by at least one holder 310 and, for example, by at least two such holders. The or each holder has elastically deformable, barb-like catches 310*a* which can be clipped from above into the adjacent frame limbs of the two frames and then grip around the lugs 306*f* of the two frame limbs. The lighting device 303 can then be suspended from a room ceiling, for example by retaining means not shown.

Figure 12:
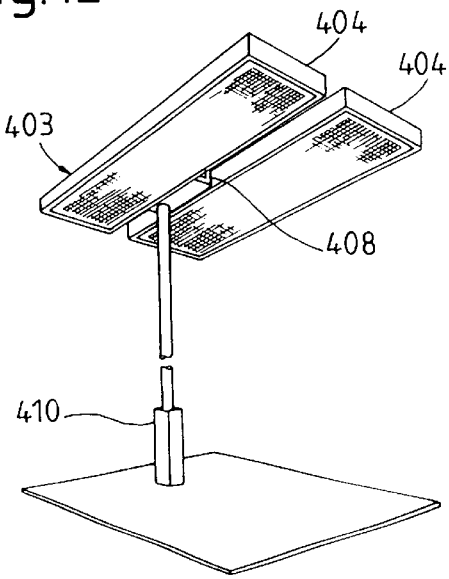
FIG. 12 shows a perspective oblique view of a standard light having two lighting units connected to one another.

FIG. 12 shows a lighting device 403 having two lighting units 404, between which a spacer 408 is arranged and which are connected to one another by said spacer by means of holders, analogously to the two lighting units 304. The lighting device 403 is in the form of a standard light and has a stand 410 with a base and a rod which, for example, is vertical and holds the spacer 408 rigidly or rotatably relative to the base and possibly in a height-adjustable manner.

Figure 13:
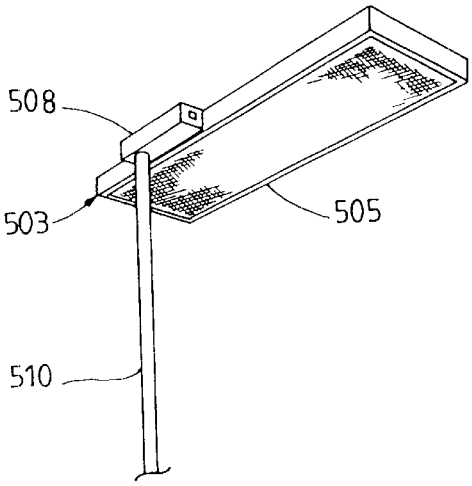
FIG. 13 shows an oblique view of a standard light having only one lighting unit.

FIG. 13 likewise shows a lighting device 503 in the form of a standard lamp. However, this does not have two lighting units but only one lighting unit, which has a housing 503. This and the parts arranged therein are formed, for example, similarly to the lighting device 203 shown in FIGS. 7 to 10. A retainer 508 is fastened to one of the frame limbs, possibly clipped onto the frame limb by means of holders. A stand 510 has a rod holding the retainer.

The housing described in FIGS. 7 to 10 and having the parts arranged therein can thus be used alternatively individually or together with a substantially identically formed housing for the formation of a light held on a room ceiling or a standard light. Similarly, such or similar housings can also be used for the formation of a wall light fastened to a wall. This wide range of potential uses of substantially identically formed housings and lighting units is economically of considerable advantage.

Figure 14:
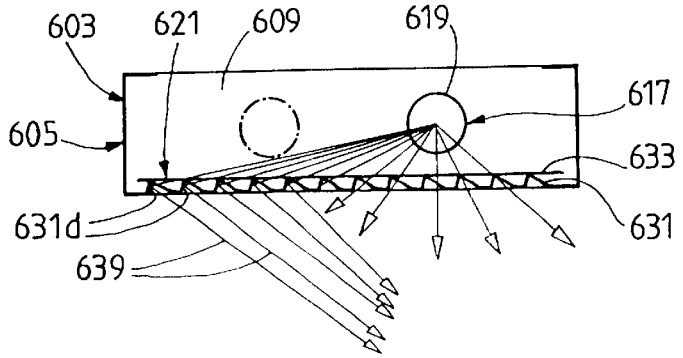
FIG. 14 shows a schematic vertical section through a lighting device having a distributor element with inclined holes.
Figure 15:
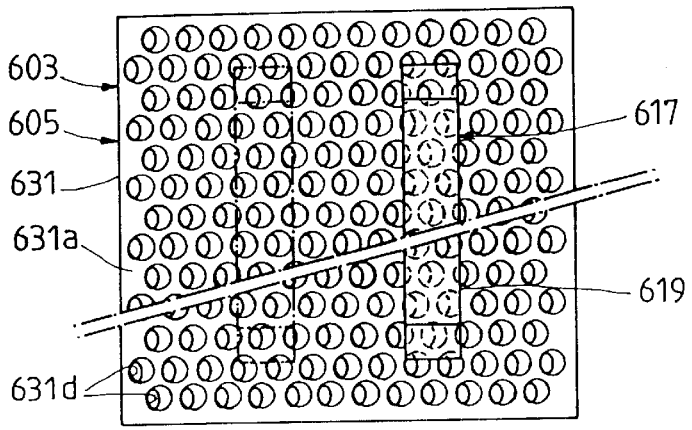
FIG. 15 shows a simplified horizontal section through the lighting device according to FIG. 14.

The lighting device 603 shown schematically in FIGS. 14 and 15 has a generally right parallelepiped housing 605 which is shown only in simplified form and has a light source chamber 505 which is open at the top at least for the most part and contains an artificial light source 617. This in turn has at least one electric lamp 619, for example a lamp indicated by solid lines and possibly also a lamp arranged adjacent to said lamp and indicated by dash-dot lines being present. The or each lamp 619 consists, for example, of a tubular fluorescent lamp running in the longitudinal direction of the housing.

The light distributor 621 of the lighting device 603 in turn has a distributor element 631 with an extensive, i.e. substantially two-dimensional, generally flat main section 631*c*. This is shown particularly clearly in FIGS. 16 and 17 and in turn has an incidence side and/or incidence surface 631*a*, a radiation side and/or radiation surface 631*b* and holes 631*d* for the passage of light. For each hole 631*d* for the passage of light, a collar 631*e* projecting upward away from the extensive main section 631*c* is once again present. Each hole 631*d* has a hole bounding surface 631*g*, a first, upper hole end 631*h* with a center 631*r*, a second, lower hole end 631*i* with a center 631*s* and a straight hole axis 631*f* running through the centers 631*r*, 631*s* of the two hole ends. The hole axis 631*f* of each hole 631*d* makes a non-90° angle with a flat surface defined and covered by the extensive main section, for example by its radiation side 631*b* and/or radiation surface 631*b*, and is parallel to a plane which is perpendicular to said flat surface defined by the main section and perpendicular to the longitudinal direction of the housing and the tubular lamp(s). The hole axes 631*f* of all holes 631*d* are, for example, inclined equally relative to the flat surface defined by the main section and are parallel to one another. Each hole axis 631*f* makes, with a normal 631*t* to the plane defined by the main section 631*c*, an angle which is denoted in FIG. 16 by y and is, for example, about 10° to 30°. In the section shown in FIG. 16, the collar 631*e* of each hole 631*d* is not rotationally symmetrical with respect to the hole axis 631*f* and is higher and steeper to the left of the hole axis than on the right side of the hole axis. The edge of the first, upper hole end 631*a* is accordingly inclined relative to the flat surface defined by the main section 631*c*.

Figure 16:
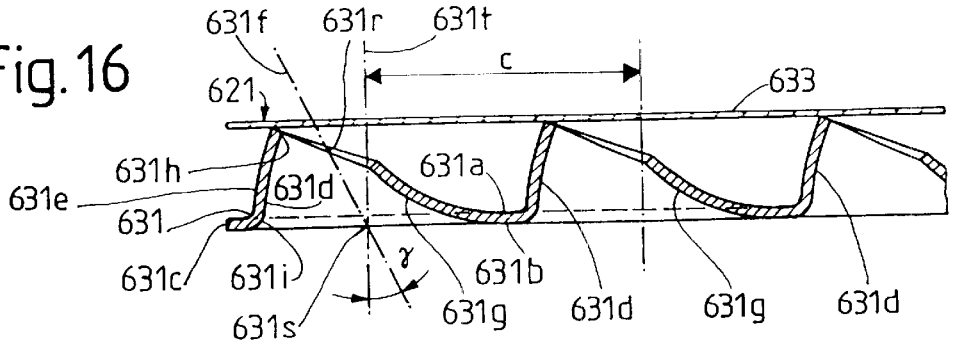
FIG. 16 shows a vertical section through the light distributor on a large scale and FIG. 17 shows a plan view of the distributor element of the light distributor on the same scale as FIG. 16.
Figure 17:
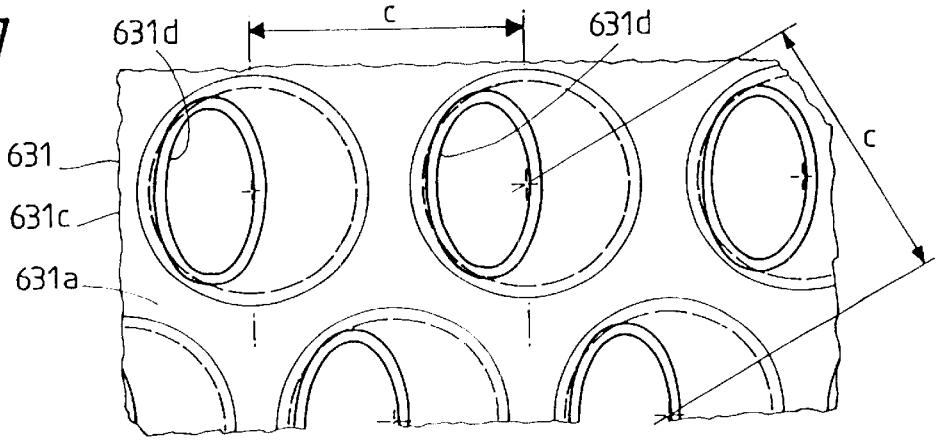

The hole bounding surface 631*g* is at least for the most part formed by the inner surface of a collar 631*e*, it also being possible to regard as part of the hole bounding surface the narrow sheet-metal inner edge surface present at the first, upper hole end and inclined differently in axial sections along the hole circumference. In all sections passing through the hole axis 631*f*, the hole bounding surface is at least for the most part—namely everywhere apart from in the region formed by the sheet-metal inner edge surface—smooth and continuously curved. In FIG. 16, the hole bounding surface is at least for the most part concave on the left, higher side of the collar and convex on the right side. In a section perpendicular to the plane of the drawing in FIG. 16 and through the hole axis 631*f*, the hole bounding surface is symmetrical to the hole axis and, for example, likewise slightly concave and/or possibly more or less straight as in the case of a cone, on both sides of said hole axis. Each hole 631*d* widens smoothly and steadily in axial sections through all circumferential points, at least in the greatest part of its axial dimension, namely everywhere apart from the sheet-metal inner edge surfaces—from the first to the second hole end. The hole bounding surface is accordingly oriented, at least for the most part of the axial dimension of the hole in all axial sections, downward toward the second hole end and outward away from the hole axis and in particular is inclined—at least apart from the edges at the upper and lower hole ends. The edge of the first, upper hole end is, for example, approximately elliptical, the longer ellipse axis being parallel to the longitudinal direction of the housing. The edge of the second, lower hole end is, for example, at least approximately circular, but the hole axis is inclined relative to the plane containing this edge and defined by the radiation side 631*b*. The dimensions and dimension ratios given for the clear width or internal diameter of the holes 31*d* of the distributor element 31 may apply with respect to the holes 631*d* of the distributor element 631, for example, to the shorter ellipse axis of the approximately elliptical first, upper hole end of the holes 631*d*.

The holes 631*d* of the distributor element 631 which are intended for the passage of light are arranged in straight rows perpendicular to the longitudinal direction of the housing, analogously to the distributor element 31. The centers 631*s* of the two hole ends 631*i* of the holes present closest together are a distance c apart in FIG. 17. The distributor element 631 may also have walls and/or reflectors associated with a main section.

The light distributor 621 also has a diffuser 633 shown only in FIGS. 14 and 16. This once again consists of a flat sheet and rests on the highest points of the collars 631*e*. The lighting device 603 also has at least one ballast which is not shown and which may be arranged, for example, similarly to one of the lighting devices 3, 203.

FIG. 14 also shows some light beams 639 which pass from the lamp indicated by solid lines to the light distributor 621 and through the latter downward out of the housing 605. These light beams have approximately the average radiation direction of the light radiated by the lamp through the various holes 631*d* of the distributor element 631 which are intended for the passage of light. Owing to the asymmetrical formation of the holes 631*d*, more light is radiated downward to the right than to the left. This may be expedient, for example, when the lighting device 603 is arranged in the vicinity of a wall present to the left of it. The minimum angle made by the light radiated downward from a hole with a horizontal plane may vary in different planes distributed around the axis of the hole and passing through said axis. However, the light distributor 621 is once again formed in such a way that all light radiated through it downward out of the housing makes, with a horizontal plane, at least a minimum angle a having a magnitude mentioned further above.

The lighting device 603 may be in the form of, for example, either a pendant light or a standard light or a wall light and—unless stated otherwise above—may have properties similar to the lighting devices described above.

The lighting devices, the light distributors and the production of the latter can also be modified in other ways. First, for example, features of the embodiments shown in the various Figures can be combined with one another. The housings, fastening means, reflectors and lamps of the lighting devices can likewise be modified in a variety of ways. The housing 5 shown in FIG. 1 could, for example, have only a single light source chamber with one or more lamps. Furthermore, the orifices 13, 313 of the housings open at the top could be closed by a wall section which is transparent or at least permeable to light and comprises mineral glass or plastic or can be replaced by such a wall section. The housing can then possibly have some ventilation holes for this purpose, in order to permit removal of heat by convection. Moreover, the housings can have, for example, lateral perforations in order to radiate light obliquely upward toward the room ceiling. Furthermore, the lighting device could have a housing resting against and fastened to the flat, horizontal surface of a room ceiling or could be in the form of a wall light for fastening to a wall, as has already been mentioned. In the case of the lighting devices shown in FIGS. 7 to 13, the frame of the housing can be formed from at least one sheet-metal part or from a cast part instead of from profile rods. Moreover, the lighting device could have a fluorescent lamp with a circular tube. The light distributor arranged under this can then likewise form a circular ring. This annular light distributor, for example, may be flat or may be curved in sections through the vertical central axis surrounded by the ring, so that the incidence side or surface of the main section of the annular distributor element is concave in axial sections. Furthermore, the lighting device can have at least one electric incandescent lamp and/or halogen lamp instead of at least one fluorescent lamp or in addition to such a lamp.

In a direction of view parallel to the hole axis, the bounding surfaces and/or hole ends of the holes for the passage of light may form, for example, a regular polygon, for example a square or hexagon or may be elongated and more or less slot-like. The hole axes may then additionally make a non-90° angle with that region of the extensive main section which has the relevant hole and/or with a horizontal plane, analogously to the distributor element 631. Furthermore, only some of the holes for the passage of light could have, at least at the first and/or second hole end, a contour which is not rotationally symmetrical with respect to the hole axis, and/or a hole axis, which make a non-90° angle with the surface defined by the extensive main section.

As already described, the light distributors of the lighting device shown in FIGS. 7 to 17 preferably have no diaphragm corresponding to the diaphragm 35. It may even be possible to omit the diffusers of the light distributors, so that the light distributors have only the distributor element 31 or 131 or 231.

Furthermore, a light distributor may have a plurality of distributor elements distributed along its length, and possibly diaphragms and diffusers. If diaphragms are present, the or each diaphragm and the or each distributor element could furthermore be displaceable relative to one another, possibly by means of an adjusting device. The holes of the diaphragm which are intended for the passage of light can then either be made to coincide approximately with the holes of the coordinated distributor element which are intended for the passage of light or can be offset relative to these holes. Consequently, the illumination and brightness produced by the lighting device could be adjusted.

Furthermore, the distributor elements and the diaphragms can, for example, be produced from sheet-metal parts originally having no special reflection layers and can be provided with at least one light-reflecting surface only after the production of the holes for the passage of light and collars, by polishing and/or vapor deposition and/or similar methods. It may even be possible to produce the distributor elements and/or the diaphragms by injection molding from plastic and then to provide them with at least one reflection layer by vapor deposition.

What is claimed is:

1. A light distributor for a lighting device, comprising an integral distributor element which has an extensive main section with an incidence side intended for turning toward a light source, a radiation side facing away from said incidence side and a number of holes for the passage of light, wherein each hole has a bounding surface and wherein the holes widen from the incidence side to the radiation side, at least for the greatest part of their bounding surface.

2. The light distributor as claimed in claim 1, wherein each hole has a first hole end present on the incidence side and having a center, a second hole end arranged on the radiation side and having a center, and a straight hole axis passing through the centers of the two hole ends, and wherein, in sections through the hole axis, the bounding surface of each hole is smooth and continuous at at least almost all circumferential points and at least for the greatest part of the axial hole dimension and, from the incidence side to the radiation side, is directed away from the hole axis.

3. The light distributor as claimed in claim 2, wherein each hole is concave in the axial section, at least for the greatest part of the bounding surface of the hole.

4. The light distributor as claimed in claim 2, wherein at least some of the holes have a contour which is not rotationally symmetrical with respect to the hole axis at least at one of the hole ends and/or wherein the hole axis of at least some of the holes makes an angle with a normal to a plane defined by the extensive main section.

5. The light distributor as claimed in claim 1, wherein the distributor element has, for each hole, a collar which projects away from the main section on the incidence side of the distributor element and forms at least a part of the bounding surface of the relevant hole.

6. The light distributor as claimed in claim 5, wherein the distributor element consists of a sheet-metal part and wherein the collars are produced by forming.

7. The light distributor as claimed in claim 5, wherein the main section and the collars of the distributor element are light-reflecting on the incidence side.

8. The light distributor as claimed in claim 1, wherein the distributor element consists of light-impermeable material and wherein the bounding surfaces of the holes of the light distributor are reflective.

9. The light distributor as claimed in claim 8, wherein the distributor element consists substantially of at least one of aluminum and of an aluminum alloy and has at least one anodized surface forming the bounding surfaces of the holes.

10. The light distributor as claimed in claim 1, wherein each hole of the distributor element has a clear width and an axial dimension, measured along a hole axis, which is at least 30% and at most 100% of the clear width.

11. The light distributor as claimed in claim 10, wherein the clear width is at least 2 mm and at most 15 mm, wherein the axial dimension is at least 1.5 mm and at most 15 mm and wherein the distributor element has a material thickness which is at most 1 mm.

12. The light distributor as claimed in claim 1, which has a diffuser which is intended for arrangement between the distributor element and the light source and is permeable to light but at least one of opaque and of matt.

13. The light distributor as claimed in claim 12, which has a diaphragm which is intended for arrangement between the light source and the diffuser, wherein the diaphragm consists of a material opaque to light and has, for each hole of the distributor element, a hole coordinated therewith and a light-reflecting surface facing away from the distributor element, wherein each hole of the diaphragm coincides, or can be made to coincide, approximately with a hole of the distributor element, and wherein the holes of the diaphragm have at least approximately the same contours and cross-sectional dimensions as those ends of the holes of the distributor element which face these holes.

14. A lighting device having at least one light distributor, comprising an integral distributor element which has an extensive main section with an incidence side intended for turning toward a light source, a radiation side facing away from said incidence side and a number of holes for the passage of light, wherein each hole has a bounding surface, wherein the holes widen from that incidence side to the radiation side, at least for the greatest part of their bounding surface, and wherein said lighting device has at least one lamp holder for holding at least one electric lamp in such a way that the at least one electric lamp radiates light to the light distributor during operation.

15. The lighting device as claimed in claim 14, which has a housing and wherein said housing has at least one of at least one orifice and of at least one wall section permeable to light, which orifice or which wall section faces away from the extensive main section of the light distributor, so that light can be radiated through this orifice or this wall section permeable to light and out of the housing.

16. The lighting device as claimed in claim 14, wherein the extensive main section of the distributor element is substantially quadrilateral, has four edges and is associated, at at least two edges opposite one another, with walls which are at least one of angled and of bent away from the extensive main section and which, together with the extensive main section, consist of an integral metal sheet.

17. The lighting device as claimed in claim 16, wherein the housing has a frame with four frame limbs and wherein at least two walls opposite one another and associated with the extensive main section of the distributor element are detachably fastened to the frame.

18. A use of a lighting device having at least one light distributor, comprising an integral distributor element which has an extensive main section with an incidence side intended for turning toward a light source, a radiation side facing away from said incidence side and a number of holes for the passage of light, wherein each hole has a bounding surface, wherein the holes widen from the incidence side to the radiation side, at least for the greatest part of their bounding surface, wherein said lighting device has at least one lamp holder for holding at least one electric lamp in such a way that the at least one electric lamp radiates light to the light distributor during operation and wherein the lighting device is arranged in such a way that all light radiated through the light distributor and out of the light distributor makes an angle with a horizontal plane.

19. The use as claimed in claim 18, wherein said angle is at least 25°.

20. The use as claimed in claim 18, wherein light is radiated upward out of the housing.

* * * * *

UNITED STATES PATENT AND TRADEMARK OFFICE

CERTIFICATE OF CORRECTION

PATENT NO. : 6,457,844 B2
DATED : October 1, 2002
INVENTOR(S) : Jean-Marc Hess

It is certified that error appears in the above-identified patent and that said Letters Patent is hereby corrected as shown below:

Title page,
Item [73], should read:
-- [73] Assignee: Regent Beleuchtungskoerper AG
Basel (CH) --

Signed and Sealed this

Twenty-fifth Day of March, 2003

JAMES E. ROGAN
*Director of the United States Patent and Trademark Office*